US008074669B2

(12) United States Patent
Collins et al.

(10) Patent No.: US 8,074,669 B2
(45) Date of Patent: Dec. 13, 2011

(54) EXPANDABLE-COLLAPSIBLE MULTIPURPOSE FRAME APPARATUS

(76) Inventors: Scott Collins, Westford, MA (US); Steve Wakefield, Billerica, MA (US)

( * ) Notice: Subject to any disclaimer, the term of this patent is extended or adjusted under 35 U.S.C. 154(b) by 0 days.

(21) Appl. No.: 12/381,773

(22) Filed: Mar. 17, 2009

(65) Prior Publication Data

US 2009/0229644 A1 Sep. 17, 2009

Related U.S. Application Data

(60) Provisional application No. 61/037,212, filed on Mar. 17, 2008.

(51) Int. Cl.
*E04H 15/50* (2006.01)
*E04H 15/30* (2006.01)
*A47C 19/14* (2006.01)

(52) U.S. Cl. ..... 135/145; 135/95; 135/96; 135/123; 5/113; 5/115

(58) Field of Classification Search ..... 135/13–145, 135/905; 5/113, 115–116, 182; 248/277.1, 248/188.3, 188.5; 297/106–107, 46, 428; 108/115–116, 128
See application file for complete search history.

(56) References Cited

U.S. PATENT DOCUMENTS

| | | | | |
|---|---|---|---|---|
| 3,354,596 | A * | 11/1967 | Schafer | 52/646 |
| 5,244,001 | A * | 9/1993 | Lynch | 135/145 |
| 5,274,980 | A * | 1/1994 | Zeigler | 52/646 |
| 6,446,282 | B1 * | 9/2002 | Wu | 5/115 |
| 6,564,402 | B1 * | 5/2003 | Lin | 5/115 |
| 6,708,707 | B2 * | 3/2004 | Dotterweich et al. | 135/131 |
| 6,711,761 | B2 * | 3/2004 | Choi | 5/114 |
| 6,799,594 | B2 * | 10/2004 | Kuo | 135/147 |
| 6,929,017 | B2 * | 8/2005 | Byun | 135/145 |
| 7,100,877 | B2 * | 9/2006 | Bourke et al. | 248/166 |
| 7,114,205 | B2 * | 10/2006 | Choi | 5/114 |
| 7,131,364 | B2 * | 11/2006 | Brazell | 83/477.2 |
| 7,360,549 | B2 * | 4/2008 | Seo | 135/145 |
| 7,422,026 | B2 * | 9/2008 | Kim | 135/131 |
| 7,628,166 | B2 * | 12/2009 | Carter | 135/136 |
| 2005/0205124 | A1 * | 9/2005 | Goldwitz | 135/131 |

FOREIGN PATENT DOCUMENTS

JP 2008169567 A * 7/2008

* cited by examiner

*Primary Examiner* — Winnie Yip
(74) *Attorney, Agent, or Firm* — Lambert & Associates; Gary E. Lambert; David J. Connaughton, Jr.

(57) ABSTRACT

The invention envisions a multi-purpose expandable-collapsible frame apparatus that may be used as a bed frame. The apparatus utilizes a telescoping central support apparatus designed such that when a force is applied to the central support apparatus a plurality of floating arm assemblies expand outwardly from the central support apparatus. Furthermore, support straps and a covering member add stability and utility to the frame apparatus.

11 Claims, 10 Drawing Sheets

EXPANDABLE-COLLAPSIBLE MULTIPURPOSE FRAME APPARATUS

CROSS REFERENCE TO RELATED APPLICATION

This application claims the benefits of and claims priority from Provisional Application Ser. No. 61/037,212 filed on Mar. 17, 2008, the contents of which are hereby incorporated by reference.

FIELD OF THE INVENTION

The present invention relates generally to expandable frames that support weight and more specifically to expandable frames that may serve as a bed frame or other similar devices.

BACKGROUND OF INVENTION

Expandable-collapsible frames have been developed over the years in various forms and styles. Some possess designs directed toward mechanisms for sleeping and/or lounging, these include foldable futons wherein a top section may bend over a bottom section, or some designs which employ three or more foldable sections are involved. Other types of mechanisms rely on scissor type designs that comprise leg members that when not in use are folded in such a manner as to rest within substantially the same plane as a frame member and then extend outward until they are substantially perpendicular to said frame member when the legs are in use.

Upon the development of durable and semi-durable air beds (and or other portable type mattresses) additional designs were developed that allowed for substantially inward collapsibility verses the intra-planar collapsibility designs. Thus, these more portable frames could be transported with these new highly portable mattresses. These inwardly collapsing portable frames allowed for the frame to collapse so that the frame's length and width dimensions, while collapsed, were a fraction of the frame's length and width when it was fully expanded. However, these collapsible frames still required multiple exertions of force in order to expand the mattress until it was fully constructed.

The required pushing and pulling from external forces to expand these earlier inwardly collapsible frames increase the user's time needed for assembly of the frame. Further, when users applied forces on the frame during assembly, these forces could inadvertently produce undesirable torsion on various frame joints causing improper twisting on the frame which leads to decreased frame durability and longevity. Additionally, these inwardly collapsible frames were often designed specifically to solely meet one particular function, such as supporting mattresses and thus systems that facilitate multiple purposes were not addressed and therefore not implemented.

What is needed is an inwardly collapsible, multi-purpose frame apparatus that prevents the improper application of force during setup that may inadvertently damage the frame. This invention provides that functionality.

SUMMARY OF THE INVENTION

The instant invention, as illustrated herein, is clearly not anticipated, rendered obvious, or even present in any of the prior art mechanisms, either alone or in any combination thereof. An expandable-collapsible frame apparatus designed to overcome the previously mentioned shortcomings would give users a much more effective means of quickly and conveniently setting up the a portable frame without risking to put inadvertent strain on the frame itself. Thus, the several embodiments of the instant invention are illustrated herein.

Therefore, it is an object of the present invention to overcome the previously mentioned shortcomings of other collapsible frame apparatuses by providing an expandable-collapsible frame apparatus that comprises a central support apparatus, wherein this central support apparatus is telescopic and depressible.

Another object of the present invention is to provide an expandable-collapsible frame apparatus that comprises at least one floating support member that is driven out from the center support member when the center support member is depressed.

Another object of the present invention is to provide an expandable-collapsible frame apparatus that comprises support straps that span each axis of the frame along expanding floating arm members to provide stability as the arms expand.

Another object of the present invention is to provide an expandable-collapsible frame apparatus that comprises support straps that span each axis of the frame along expanding floating arm members to provide stability as the arms expand and help to lock out the apparatus arms when weight is applied to the frame.

Another object of the present invention is to provide an expandable-collapsible frame apparatus that comprises at least one floating arm assembly that is driven out from the center support member when the center support member is depressed and, wherein said at least one floating arm assembly is telescopic.

Another object of the present invention is to provide an expandable-collapsible frame apparatus that comprises at least one floating arm assembly that is driven out from the center support member when the center support member is depressed and, wherein said at least one floating arm assembly comprises at least one scissor joint.

Another object of the present invention is to provide an expandable-collapsible frame apparatus that comprises at least one floating arm assembly that is driven out from the center support member when the center support member is depressed and, wherein said at least one floating arm assembly comprises at least one telescoping support member.

Another object of the present invention is to provide an expandable-collapsible frame apparatus that comprises a cover substantially comprising light weight flexible materials.

Another object of the present invention is to provide an expandable-collapsible frame apparatus that comprises a cover substantially comprised of textile materials.

Another object of the present invention is to provide an expandable-collapsible frame apparatus that comprises a cover substantially comprised of textile materials, wherein upon actuation of the central support apparatus, the cover becomes substantially taught, thereby allowing the frame to mechanically function similar to an umbrella.

These together with other objects of the invention, along with various features of novelty which characterize the invention, are pointed out with particularity in the claims and Detailed Description of the Embodiments Sections, and drawings of this application, with all said sections also adding to this disclosure. The instant invention as illustrated herein, is clearly not anticipated, rendered obvious, or even present in any of the prior art mechanisms, either alone or in any combination thereof.

There has thus been outlined, rather broadly, the more important features of the frame in order that the detailed description thereof that follows may be better understand, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

DETAILED DESCRIPTION OF THE DISCLOSED EMBODIMENTS

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as expandable-collapsible frame apparatuses of different shapes, dimensions components and materials.

Figure 1:
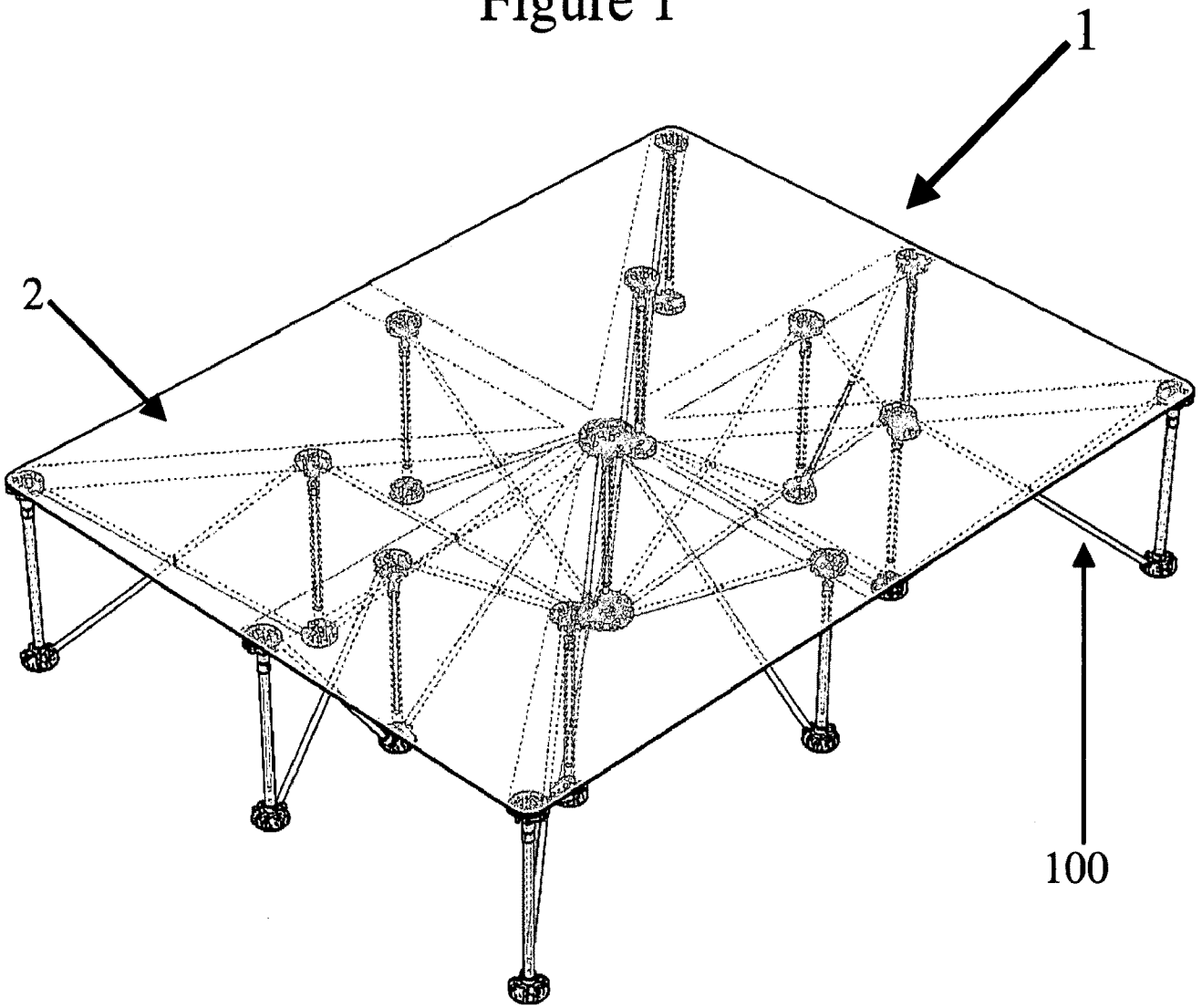
FIG. 1 illustrates an isometric view of the multi-function expandable-collapsible frame apparatus with a cover over it.

FIG. 1 illustrates on embodiment of the invention, wherein the multi-function expandable-collapsible frame apparatus 1 is intended to be used as a bed frame. In this embodiment the frame assembly 100 is topped off by a covering member 2 that is held taught by the tension from the outer edges of said frame member 100 while said frame member 100 is in its fully expanded position.

Figure 2:
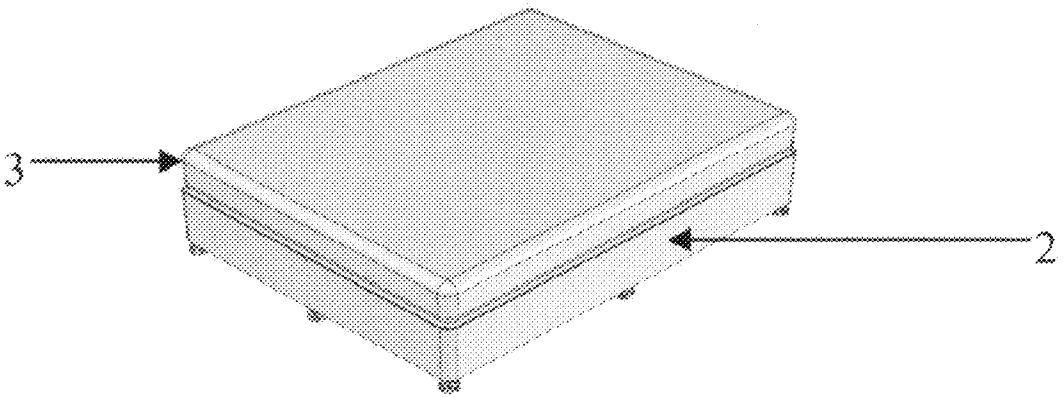
FIG. 2 illustrates an isometric view of the multi-function expandable-collapsible frame apparatus with a bed mattress resting upon it.
Figure 3:
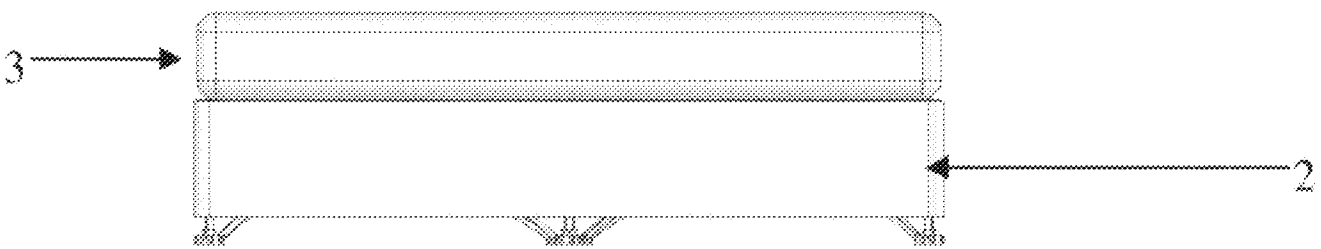
FIG. 3 illustrates a side view of the multi-function expandable-collapsible frame apparatus with a bed mattress resting upon it.
Figure 5:
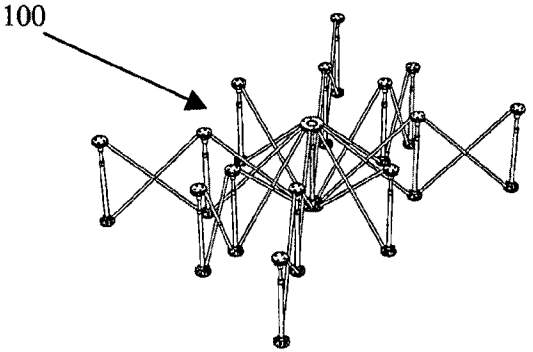
FIG. 5 illustrates an isometric view of the multi-function expandable-collapsible frame beginning to collapse inwardly from its fully expanded position.

FIGS. 2 and 3 illustrate a second embodiment of the instant invention serving as a bed frame as in FIG. 1. In this embodiment the frame assembly 100 is again covered by a covering member 2, however, in this embodiment the covering member is pulled down so as to substantially cover said frame assembly 100. This embodiment also further displays the frame assembly 100 supporting the weight of a mattress 3.

Figure 4:
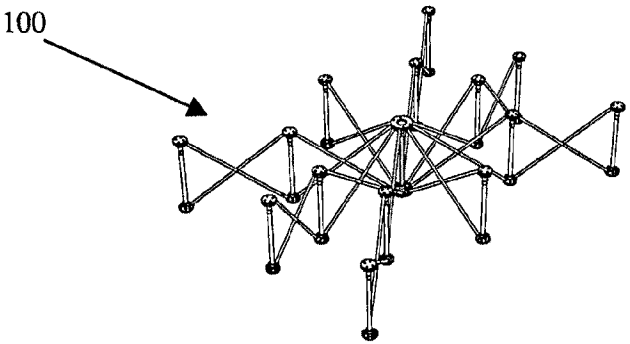
FIG. 4 illustrates an isometric view of the multi-function expandable-collapsible frame while fully expanded.
Figure 8:
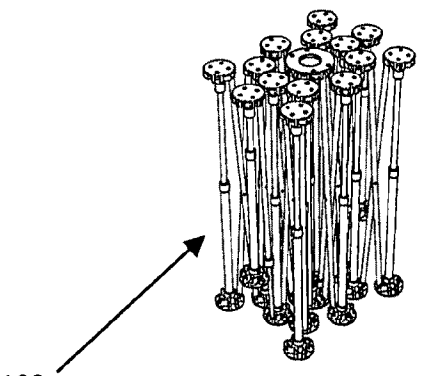
FIG. 8 illustrates an isometric view of the multi-function expandable-collapsible frame in a fully collapsed state.
Figure 7:
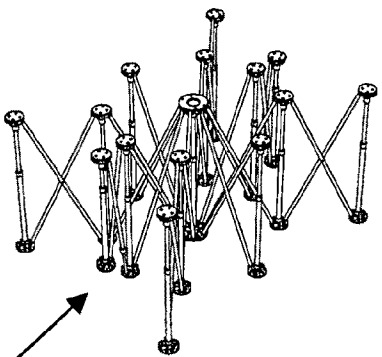
FIG. 7 illustrates an isometric view of the multi-function expandable-collapsible frame collapsing inwardly and approaching its fully collapsed state.
Figure 6:
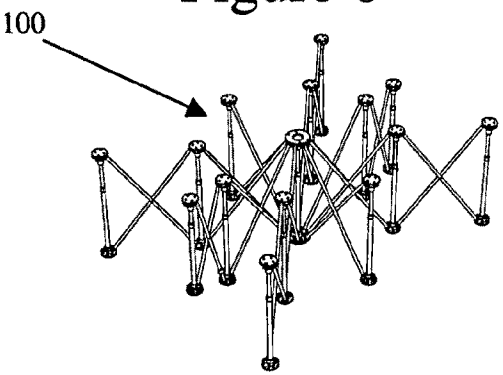
FIG. 6 illustrates an isometric view of the multi-function expandable-collapsible frame collapsing inwardly from its fully expanded position.

FIGS. 4, 5, 6, 7 and 8 illustrate the frame assembly 100 in various states of expansion (or contraction). FIG. 4 illustrates the frame assembly 100 in a substantially fully expanded state, while FIGS. 5, 6 and 7 then illustrate the frame assembly 100 in successively increasing states of expansion. Finally, FIG. 8 illustrates the frame assembly in a substantially collapsed (folded) state.

Figure 9:
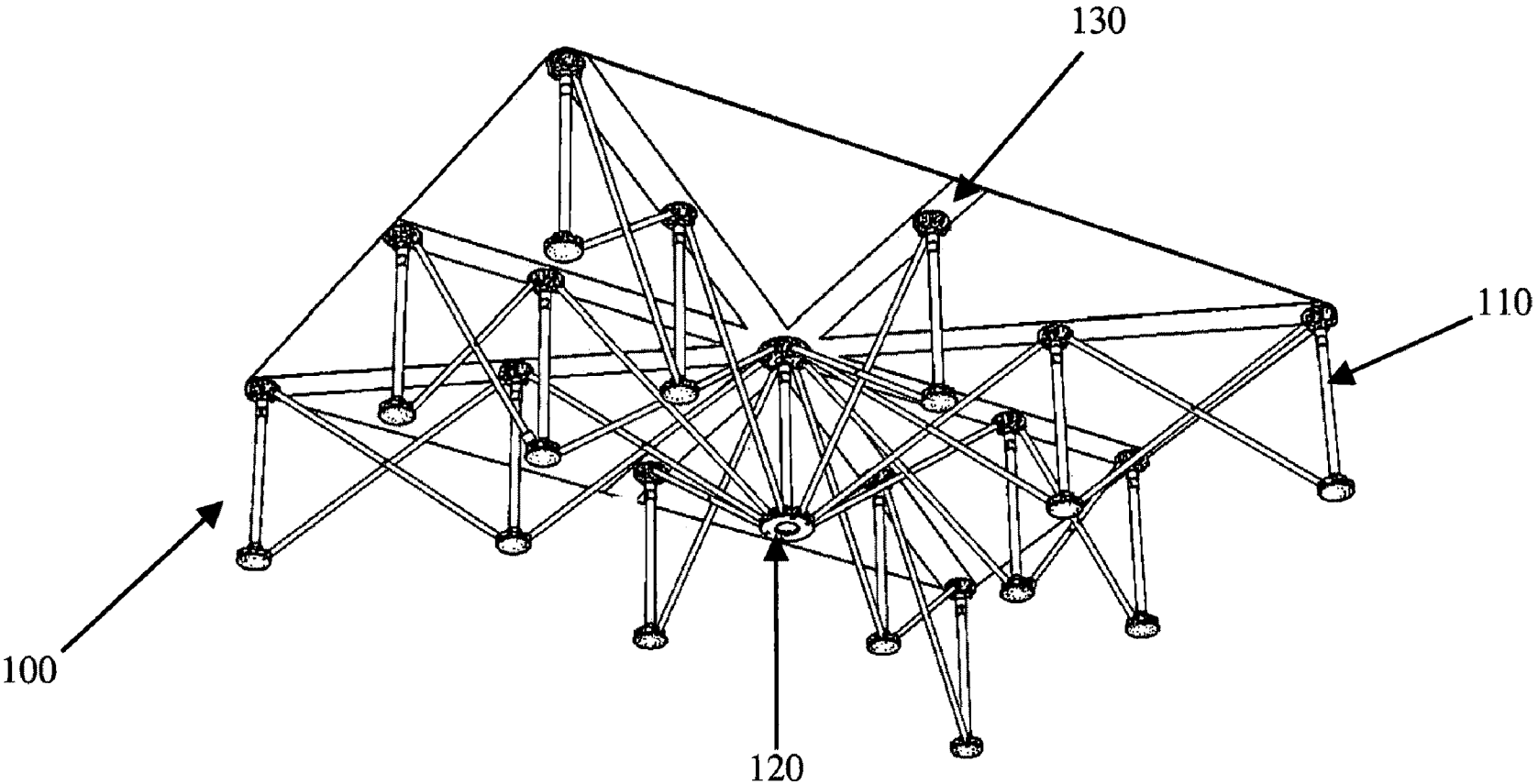
FIG. 9 illustrates a bottom isometric view of the multi-function expandable-collapsible frame with a cover over it.
Figure 10:
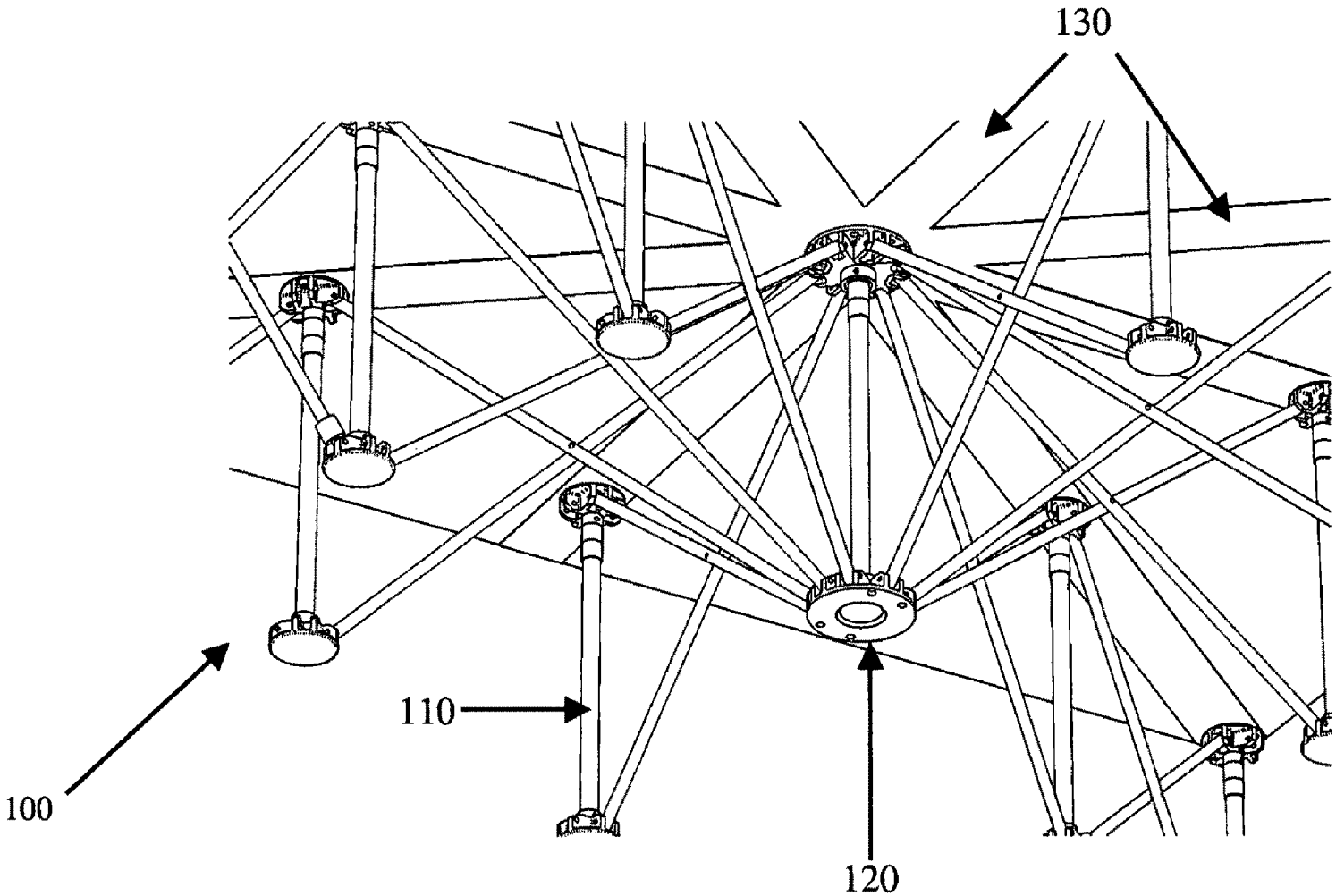
FIG. 10 illustrates a sectional bottom isometric view of the multi-function expandable-collapsible frame with a cover over it.

FIGS. 9 and 10 illustrate a bottom isometric view of the multi-function expandable-collapsible frame apparatus 1, displaying the components of the fully assembled apparatus. Clearly visible in this view are various expandable leg assemblies 110, a central support assembly 120 and a plurality of support straps 130 substantially placed in the covering member 2 attached to the leg assemblies 110 and central support assembly 120.

Figure 11:
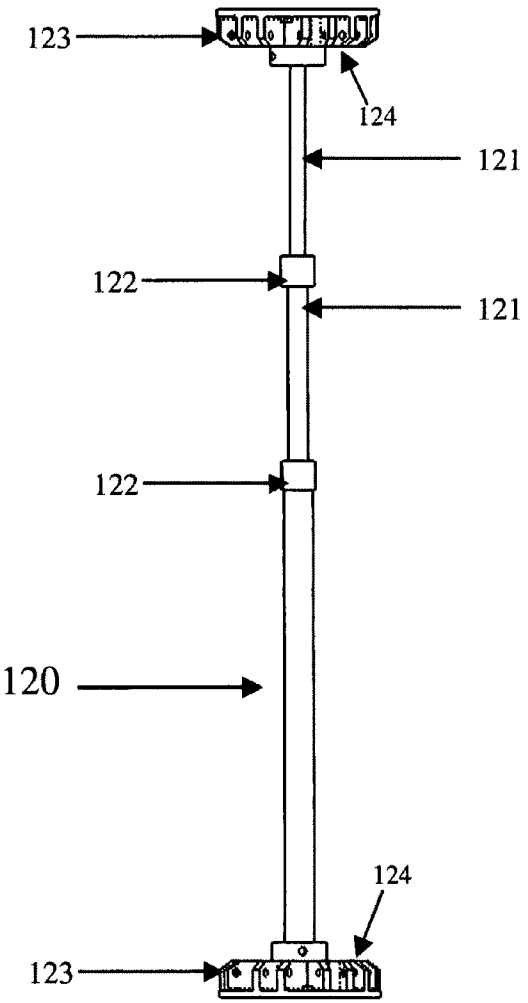
FIG. 11 illustrates an external side view of a central support assembly.

FIGS. 11, 12, 13 and 14 illustrate various views of the central support assembly 120. Specifically, FIG. 11 illustrates an external view of the central support assembly 120, wherein the central support assembly comprises a plurality of substantially hollow support shaft members 121 and a plurality of capped joint members 122. As illustrated, the substantially hollow support shaft members 121 vary in their diameter sizes so that one support shaft member of a smaller diameter may rest within the diameter of another slightly larger support shaft member and with the diameter of said slightly larger support shaft member's respective capped joint member 122. Further illustrated in FIG. 11 are a top and bottom central joint member 123 that comprises a plurality of joint cavities 124, wherein the diameter of side leg frame members 114 may fit within said plurality of joint cavities 124.

Figure 12:
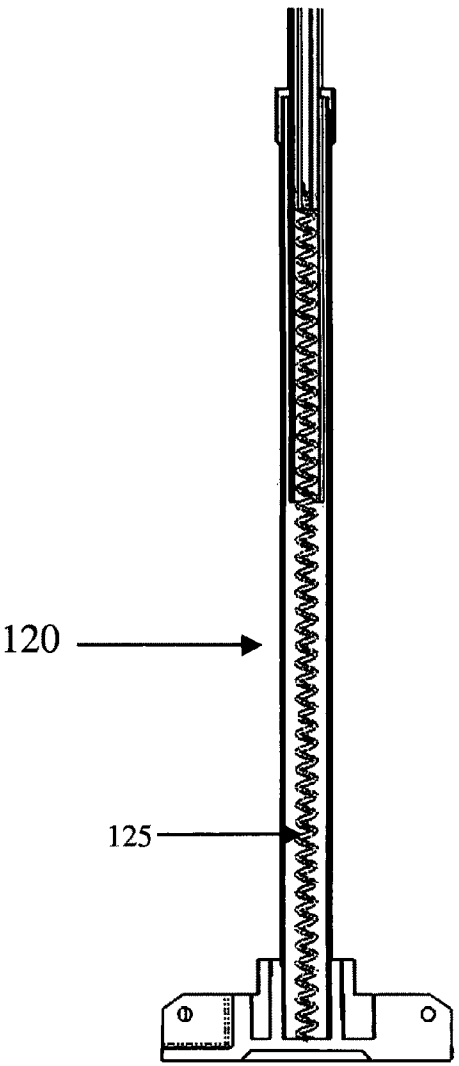
FIG. 12 illustrates an internal side view of a central support assembly.
Figure 14:
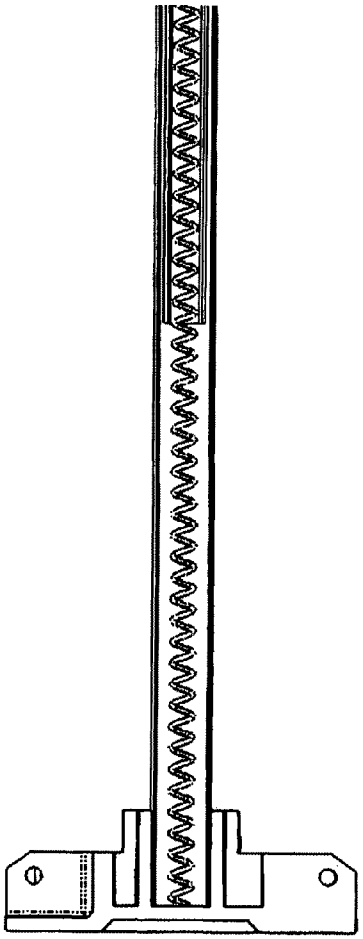
FIG. 14 illustrates a sectional internal side view of a central support assembly, wherein the base support member is shown.
Figure 13:
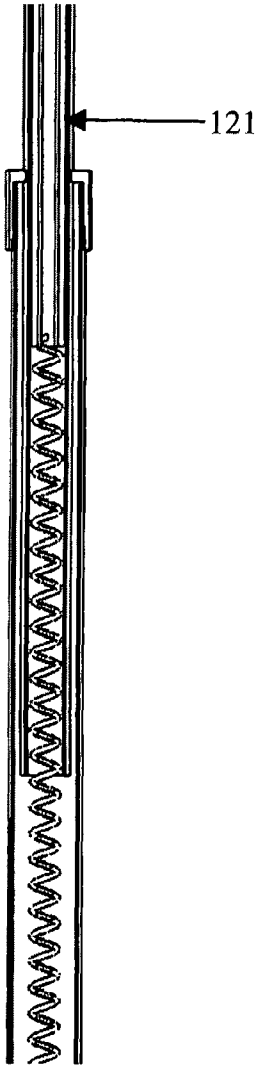
FIG. 13 illustrates a sectional internal side view of a central support assembly, wherein the base support member is not shown.

FIGS. 12, 13 and 14 illustrate various internal views of the central support assembly 120. In each figure a central spring member 125 is shown running the length of at least one substantially hollow support shaft member 121 and substantially rests within said support shaft members and said plurality of capped joint members. Further illustrated in FIGS. 12 and 13 is a substantially hollow support shaft member 121 resting within a second substantially hollow support shaft member 121 and a capped joint member 122. FIG. 14 illustrates where one substantially hollow support shaft member 121 rest on the bottom central joint member 123, wherein said shaft member is held to said central joint member 123 by an attaching means.

Figure 16:
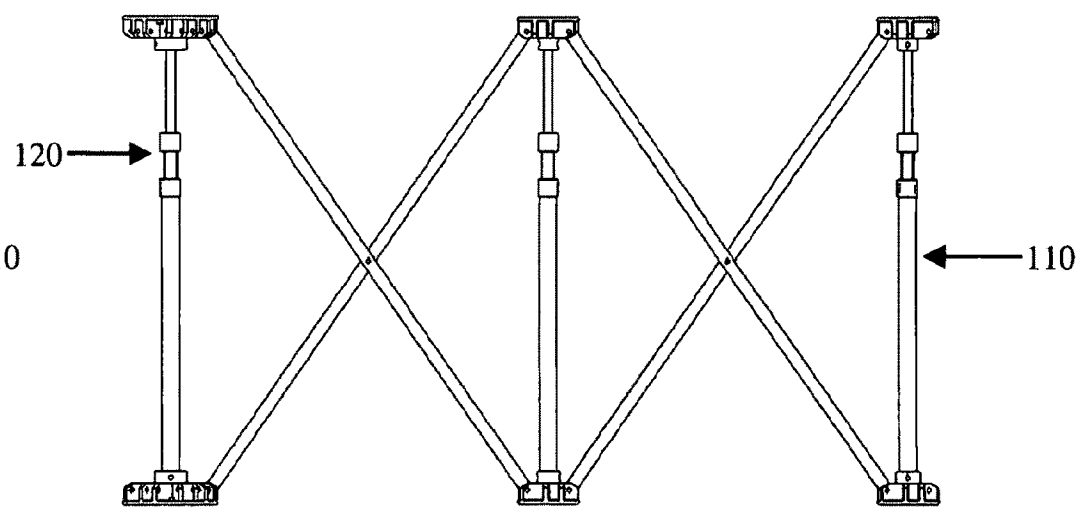
FIG. 16 illustrates side view of one leg assembly of the multi-function expandable-collapsible frame while partially expanded.
Figure 15:
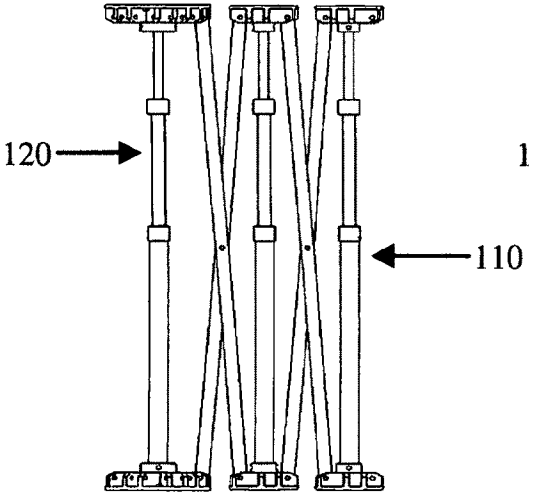
FIG. 15 illustrates side view of one leg assembly of the multi-function expandable-collapsible frame while substantially collapsed.
Figure 17:
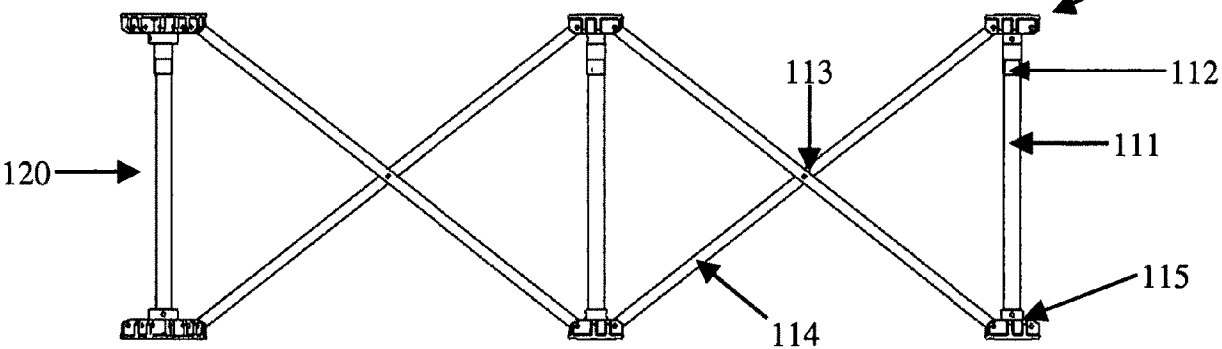
FIG. 17 illustrates side view of one leg assembly of the multi-function expandable-collapsible frame while fully expanded.

FIGS. 15, 16 and 17 illustrate expandable leg assemblies 110 in various stages of expansion and contraction. FIG. 14 illustrates an embodiment of the instant invention, wherein two expandable leg assembly 110 sections are attached to a central support assembly 120. Further, note that each separate leg assembly 110 section comprises at least one substantially hollow leg support member 111, least one capped leg joint member 112 and top and bottom leg assembly joints 115.

Additionally, crossing side leg frame members 114 that are hingedly attached at, or near, the respective midpoints of said side leg frame members 114 attach to either the central support assembly 120 by the central joint member 123 (resting and attached within one member of the plurality of joint cavities 124) or to a second expandable leg assembly 110 (attached to the second expandable leg assembly at its leg assembly joints 115). The substantially hollow leg support members 111 are disposed to allow telescoping height in the leg assembly 110 and said leg support members 111 rest within one another and said capped leg joint members in a manner substantially similar to the manner in which the substantially hollow support shaft member 121 of the central support assembly 120 are constructed including its own internal spring member. Further, in some embodiments of the instant invention, the leg assemblies 110 may rest higher then the central shaft assembly 120, in this way reducing contact with the surface that the frame assembly 100 is expanding over.

Figure 19:
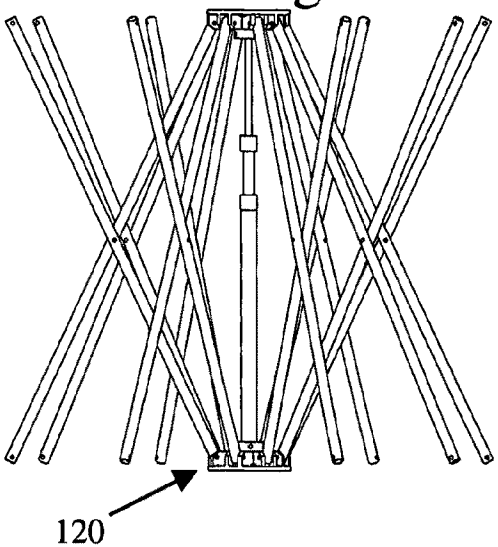
FIG. 19 illustrates side view of the central shaft member with support arms from various leg assemblies about the central shaft member while the frame apparatus is partially collapsed.
Figure 20:
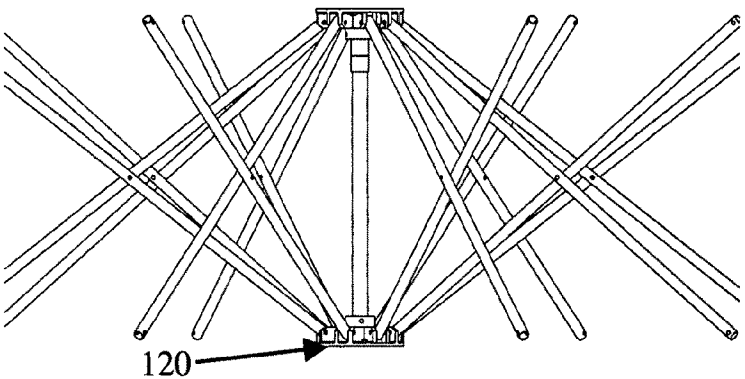
FIG. 20 illustrates side view of the central shaft member with support arms from various leg assemblies about the central shaft member while the frame apparatus is substantially expanded.
Figure 18:
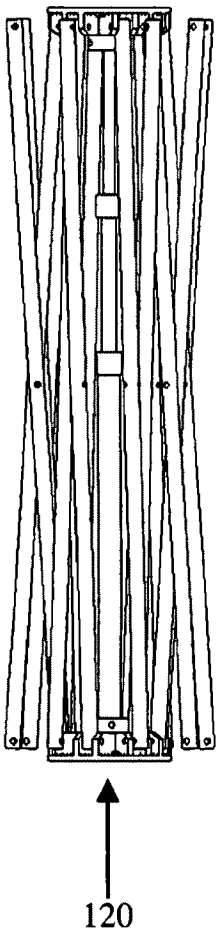
FIG. 18 illustrates side view of the central shaft member with support arms from various leg assemblies about the central shaft member while the frame apparatus is substantially collapsed.

FIGS. 18, 19 and 20 illustrate various views of the central shaft assembly 120, surrounded by attached side leg frame members 114 while the frame assembly 100 is in various stages of expansion and contraction. As illustrated, when force is applied inwardly toward the center of the central shaft assembly 120, this causes force to be applied on the attached side leg frame members 114 and thereby causing any directly or indirectly attached leg assemblies 110 to expand.

Figure 21:
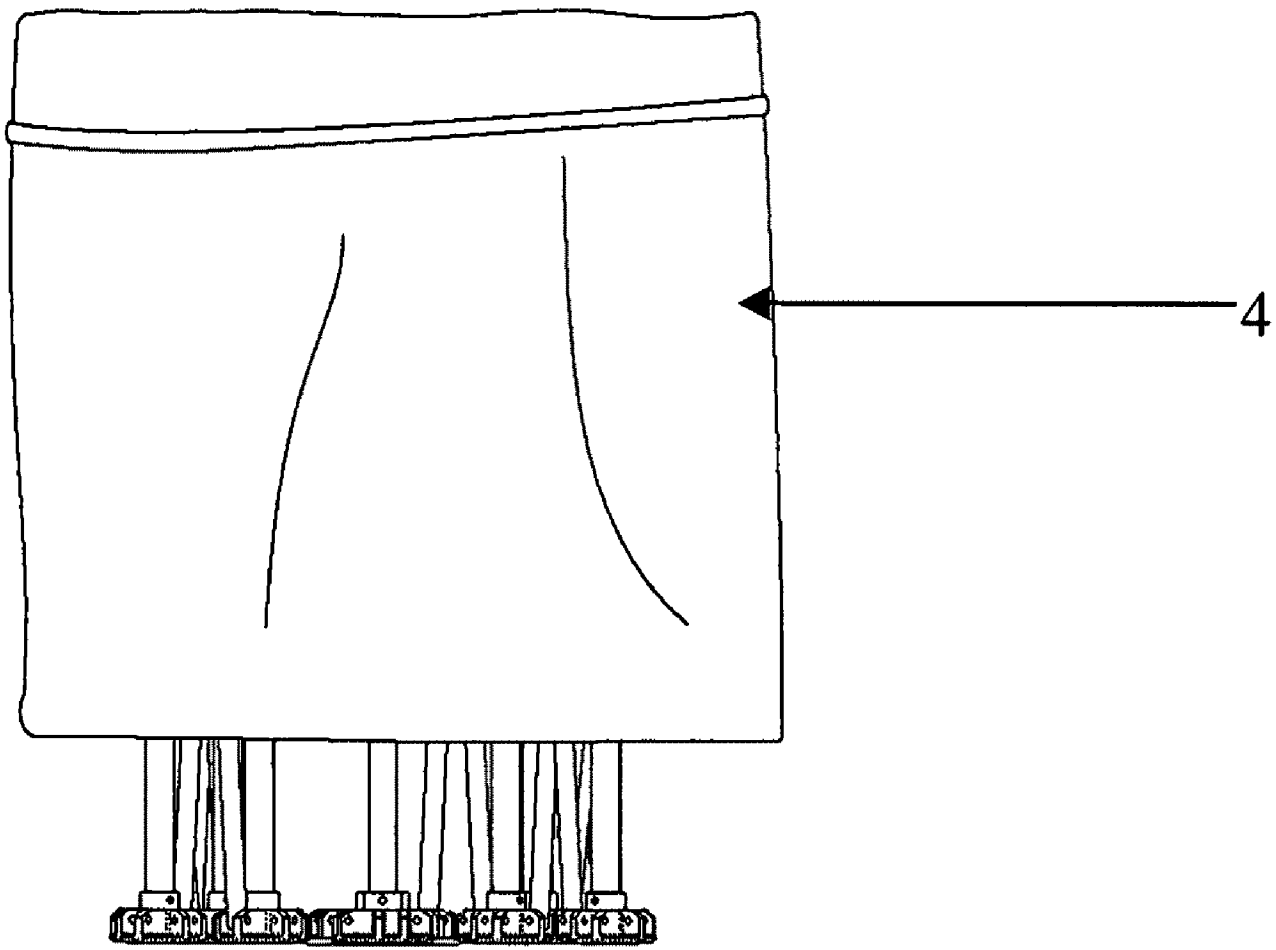
FIG. 21 illustrates side view of the multi-function expandable-collapsible frame apparatus while substantially collapsed and substantially covered by a textile cloth member constrained by flexible cord segment as part of cloth assembly.

FIG. 21 illustrates packing device 4, the instant invention is used to contain the assembly to aid in storage or for it to be placed within a transporting device such as a carrying case, or other similar containment device for packing.

We claim:

1. A multi-function expandable-collapsible frame apparatus comprising:

a central support assembly, wherein the central support assembly further comprises a top central joint member and a bottom central joint member;

a plurality of central leg assemblies, wherein each of the central leg assemblies further comprise a top assembly joint and a bottom assembly joint;

a plurality of side leg assemblies, wherein each of the plurality of side leg assemblies further comprise a top assembly joint and a bottom assembly joint;

a plurality of crossing central leg frame members, wherein one of the plurality of central leg frame members radially extends outward from the top central joint member of the central support assembly to the corresponding bottom assembly joint of the adjacent one of the plurality of central leg assemblies and wherein another of the plurality of central leg frame members radially extends outward from the bottom central joint member of the central support assembly to the corresponding top assembly joint of the adjacent one of the plurality of central leg assemblies;

a plurality of crossing side leg frame members, wherein one side leg frame member radially extends outward from the top assembly joint of one of the plurality of central leg assemblies to the corresponding bottom assembly joint of one of the plurality of adjacent side leg assemblies, and wherein another one side leg frame member radially extends outward from the bottom assembly joint of the one of the plurality of central leg assemblies to the corresponding top assembly joint of the adjacent one of the plurality of side leg assemblies;

wherein each of the plurality of side leg assemblies are only radially attached to one of the plurality of central leg assemblies, and are not laterally attached to any other of the plurality of side leg assemblies;

wherein each of the plurality of central leg assemblies are only radially attached to the central support assembly and attached to only one of the plurality of side leg assemblies; and a plurality of cross strap members, wherein each cross strap member is disposed to the top central joint member of the central support assembly and the top assembly joint of at least one of the plurality of central leg assemblies to provide support for the multi-function expandable-collapsible frame apparatus such that when a force is applied to the central support assembly the multi-function expandable-collapsible frame apparatus further stabilizes by creating a tension in a covering member, and in the expanded frame apparatus.

2. The multi-function expandable-collapsible frame apparatus of claim 1, wherein each individual of said plurality of central leg assemblies and each individual of said plurality of side leg assemblies further comprises a plurality of substantially hollow leg support members, and wherein said plurality of crossing side leg frame members further comprises a scissor joint.

3. The multi-function expandable-collapsible frame apparatus of claim 2, wherein each individual of said top and bottom assembly joints of said plurality of central leg assemblies further comprises a joint cavity, and wherein each individual of said top and bottom assembly joints of said plurality of side leg assemblies further comprises a joint cavity.

4. The multi-function expandable-collapsible frame apparatus of claim 3, wherein said central support assembly further comprises:

a substantially hollow support shaft member;

a capped joint member, wherein said substantially hollow support shaft member substantially passes through said capped joint member; and a central spring member, wherein said central spring member rests within said substantially hollow support shaft member.

5. The multi-function expandable-collapsible frame apparatus of claim 4, wherein said top and bottom central joint members further comprise a joint cavity.

6. The multi-function expandable-collapsible frame apparatus of claim 5, wherein said central support assembly is substantially telescoping.

7. The multi-function expandable-collapsible frame apparatus of claim 6, wherein each member of said plurality of substantially hollow leg support members of said plurality of side leg assemblies are substantially telescoping; and wherein each member of said plurality of substantially hollow leg support members of said plurality of central leg assemblies are substantially telescoping.

8. The multi-function expandable-collapsible frame apparatus of claim 7, wherein, upon application of a downward vertical force on said central support assembly, said plurality of central leg assemblies and said plurality of side leg assemblies expand outwardly.

9. The multi-function expandable-collapsible frame apparatus of claim 8, wherein at least one member of said plurality of substantially hollow leg support members of said plurality of side leg assemblies comprises a diameter substantially disposed to pass through a diameter of a second member of said plurality of substantially hollow leg support members of said plurality of side leg assemblies; and wherein at least one member of said plurality of substantially hollow leg support members of said plurality of central leg assemblies comprises a diameter substantially disposed to pass through a diameter of a second member of said plurality of substantially hollow leg support members of said plurality of central leg assemblies.

10. The multi-function expandable collapsible frame apparatus of claim 9, wherein a first member of said plurality of substantially hollow leg support members of said plurality of side leg assemblies comprises an outer diameter substantially equal to an inner diameter of a second member of said plurality of substantially hollow leg support members of said plurality of side leg assemblies, and said first member is disposed to pass through the inner diameter of said second member of said plurality of substantially hollow leg support members of said plurality of side leg assemblies and, wherein said inner diameter is substantially disposed to allow a leg spring member resting within second member of said plurality of substantially hollow leg support members of said plurality of side leg assemblies, wherein said leg spring member substantially rests within one of the plurality of said substantially hollow leg support members of said plurality of side leg assemblies; and wherein a first member of said plurality of substantially hollow leg support members of said plurality of central leg assemblies comprises an outer diameter substantially equal to an inner diameter of a second member of said plurality of substantially hollow leg support members of said plurality of central leg assemblies, and said first member is disposed to pass through the inner diameter of said second member of said plurality of substantially hollow leg support members of said plurality of central leg assemblies and, wherein said inner diameter is substantially disposed to allow a leg spring member resting within second member of said plurality of substantially hollow leg support members of said plurality of central leg assemblies, wherein said leg spring member substantially rests within one of the plurality of said substantially hollow leg support members of said plurality of central leg assemblies.

11. The multi-function expandable-collapsible frame apparatus of claim 1 wherein said multi-function expandable-collapsible frame apparatus comprises a transportable bed.

* * * * *